United States Patent [19]

King

[11] 4,265,697

[45] May 5, 1981

[54] SPRING LOADED FREE FLOATING STRIPPER FINGER WITH STABILIZER FOR A WEB CORRUGATING MACHINE

[76] Inventor: Joseph A. King, 3020 Fields Dr., Raleigh, N.C. 27603

[21] Appl. No.: 114,992

[22] Filed: Jan. 24, 1980

Related U.S. Application Data

[63] Continuation-in-part of Ser. No. 110,408, Jan. 8, 1980, abandoned.

[51] Int. Cl.[3] ..... B31F 1/00

[52] U.S. Cl. ..... 156/473

[58] Field of Search ..... 156/205–208, 156/210, 470–473; 118/245; 100/174; 425/336, 369

[56] References Cited

U.S. PATENT DOCUMENTS

| | | | |
|---|---|---|---|
| 2,043,635 | 1/1936 | Swift | 425/369 |
| 3,220,911 | 11/1965 | Werner | 156/473 |

*Primary Examiner*—David A. Simmons

*Attorney, Agent, or Firm*—Mills & Coats

[57] ABSTRACT

The present invention relates to a web corrugating machine provided with a finger holder assembly that is designed to stabilize and support a plurality of stripper fingers about a corrugated roller of the corrugating machine such that the respective stripper fingers are maintained in a stable and rigid posture normal to the axis of the corrugated roller. To achieve this, each respective finger holder is provided with an upstanding locking member that engages a side edge or intermediate portion of a support bar supporting the respective finger holders, such that the upstanding locking member of the respective finger holder acts to effectively lock the finger holder from twisting and turning from side to side about the support bar. In addition, each respective finger holder is provided with flexible attaching means that allows the respective stripper fingers to flex and is further provided with biasing means for urging the respective stripper fingers toward a normal setting.

11 Claims, 6 Drawing Figures

SPRING LOADED FREE FLOATING STRIPPER FINGER WITH STABILIZER FOR A WEB CORRUGATING MACHINE

This is a continuation-in-part of an earlier filed application entitled "SPRING LOADED FREE FLOATING STRIPPER FINGER WITH STABILIZER FOR A WEB CORRUGATING MACHINE" Ser. No. 110,408 filed Jan. 8, 1980, now abandoned.

The present invention relates to corrugated cardboard manufacturing machines and more particularly to a finger holder assembly design for supporting a stripper finger adjacent a corrugated roller of the corrugated cardboard manufacturing machine.

BACKGROUND OF THE INVENTION

In manufacturing corrugated cardboard, a flat web is generally trained around a first corrugated roller that meshes with a second corrugated roller and the flat web is directed through the corrugated nip therebetween. After passing through the corrugated nip, the formed corrugated web is stripped from the corrugated roller by a stripper finger and guided and supported thereby around the second corrugated roller which generally lies adjacent a pressure roller. A second flat web is generally fed around the pressure roller and through the nip between the pressure roller and second corrugated roller where the second flat web is glued to the corrugated web to produce a corrugated cardboard segment.

In the basic process referred to above, a plurality of laterally spaced stripper fingers are positioned adjacent the second corrugated roller and functions to strip the corrugated web from the first corrugated roller and to guide the same around a substantial portion of the second corrugated roller. In addition, the respective stripper fingers function to hold the corrugated web closely adjacent the second corrugated roller prior to the mergence of the corrugated web with the flat bonding web.

In such web corrugating machines just described above, one major problem that has continuously been presented lies in the fact that the respective stripper fingers are proned to move from side to side from a desired position where the stripper fingers extend normal to the axes of the corrugated rollers. Once the stripper fingers begin to move from side to side from this normal position, they then are likely to engage and bind one or more of the adjacent corrugated rollers which will result in the stripper finger being worn and/or damaged. This is particularly true in cases where certain portions of the stripper fingers are designed to fit within a groove of a selected roller and wherein due to twisting, portions of the stripper fingers become misaligned within the grooves and wear, thereby reducing the life of such.

Finally one other problem associated with stripper fingers is the fact that they are in many cases rigidly mounted to the finger holder and the problem with misalignment is thereby compounded. Thus, when misalignment occurs, the rigid mounting does not give the stripper finger the flexibility to respond by withdrawing from engagement with an adjacent roller.

Therefore, there is a need for a stripper finger holder assembly that will stabilize the position of the stripper fingers and will essentially lock the stripper fingers in a position normal to the axis of adjacent roller. In addition, there is a need for a finger holder assembly that will maintain the stripper fingers in a proper posture adjacent a corrugated roller, but which will give the same the flexibility to float and avoid unnecessary interference if misalignment does occur.

SUMMARY OF THE INVENTION

The present invention entails an improved stripper finger holder assembly that is designed to lock and stabilize respective stripper fingers in a rigid posture adjacent a corrugated roller and to maintain such stripper fingers in a position normal to the axis of an adjacent corrugated roller. In addition, the present invention provides flexible mounting means for mounting respective stripper fingers within a slit formed within the finger holder in order that the stripper finger can flex and float back and forth while supporting a passing corrugated web between an adjacent corrugated roller and the stripper finger.

More particularly there is provided an upstanding locking member that engages an edge or intermediate portion of a finger holder support bar such that the engagement of the upstanding locking member with an edge or other vertical portion of the support bar assures that the entire finger holder is maintained in a rigid stabilized position where the finger holder and attached stripper finger extends normal with respect to the axis of an adjacent corrugated roller. With respect to the flexibility of a stripper finger within a respective finger holder, there is provided a leaf type spring interposed between the stripper finger and finger holder along with pin means that extend through lost motion slots within the finger holder so as to enable the stripper finger to have limited back and forth movement within the holding slot or slit of the finger holder.

It is, therefore, an object of the present invention to provide a finger holder assembly for a web corrugating machine that will maintain and stablize the finger holder and attached stripper fingers in a generally rigid position normal to the axis of rotation of an adjacent corrugated roller, thereby preventing the finger holder from twisting from side to side and causing the stripper finger to engage an adjacent roller which would wear and/or damage the same.

Another object of the present invention resides in an improved web corrugating machine that is provided with a stripper finger holder assembly that gives the extended stripper finger flexibility in movement so as to allow the same to respond to interference with an adjacent roller by allowing the stripper finger to move back and forth and generally up and down within the supporting slit within the finger holder itself.

A further object of the present invention resides in the provision of a web corrugating machine of the character described above wherein the improved finger holder assembly is provided with an attaching edge or surface that fits adjacent a support bar, and wherein there is provided an upstanding locking member that extends from the support edge of the finger holder and engages a side or other edge portion of the support bar such that the upstanding locking member and the support bar cooperates to lock and prevent side to side movement of said finger holder.

Still a further object of the present invention resides in the provision of a finger holder assembly of the character referred to above wherein the finger holder is provided with a leaf spring that maintains the stripper finger in a generally stable support posture, but through the provision of lost motion attaching means allows the stripper finger to float back and forth and generally up and down within the finger holder to avoid binding and to accommodate various thicknesses of corrugated web passing between the stripper finger and an adjacent corrugated roller.

Another object of the present invention is to provide an improved stripper finger holder assembly that is easy to install and maintain, relatively inexpensive, and which will not be subjected to the potential for wear and damage as stripper finger supported in conventional finger holders.

Other objects and advantages of the present invention will become apparent from a study of the following description and the accompanying drawings which are merely illustrative of the present invention.

WEB CORRUGATING MACHINE WITH IMPROVED STRIPPER FINGER HOLDER ASSEMBLY

Figure 1:
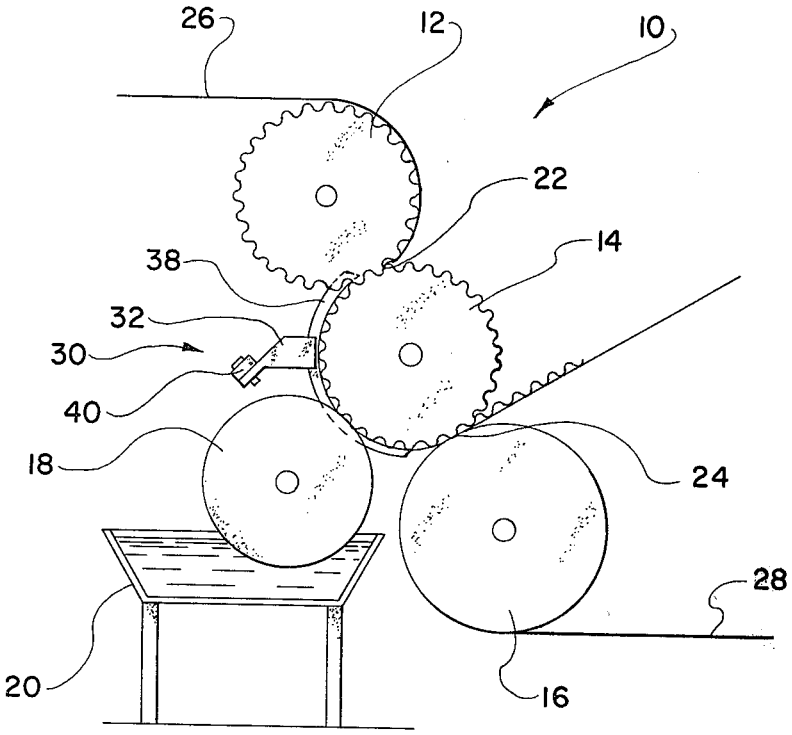
FIG. 1 is a schematic illustration illustrating the basic roller construction and layout of a conventional web corrugating machine.

With further reference to the drawings, particularly FIG. 1, there is shown therein a schematic illustration of a corrugated cardboard manufacturing machine that is indicated generally by the numeral 10. Details of such a corrugated cardboard manufacturing machine are not dealt with herein because the basic components and operation of such is well known and appreciated in the art. For example, one is referred to the disclosure found in U.S. Pat. Nos. 1,835,816; 3,346,436; 4,038,130; 4,093,497; and 3,951,725, the contents of which are all expressly incorporated herein by reference.

But for a general review of the basic components and operation of a conventional corrugated cardboard manufacturing machine 10, it is seen that the same basically comprises first and second corrugated rollers 12 and 14 that are operatively meshed together at a corrugated nip 22. In addition, operatively associated with the lower corrugated roller 14 is a pressure roller 16 that is disposed such that a circumferential side thereof comes into contact with roller 14 at a pressure nip 24. Finally, disposed adjacent corrugated roller 14 is a glue roller 18 that turns within a glue container 20 so as to receive glue thereon, after which the glue is transferred to the web material passing between rollers 14 and 18.

Reviewing the basic corrugated cardboard manufacturing process, it is seen that a first flat web 26 is directed around corrugated roller 12, and that web 26 is fed through corrugated nip 22 causing web 26 to be formed into a corrugated web sheet. Web 26 is then stripped from corrugated roller 12 and directed around corrugated roller 14 where the corrugated web is directed through pressure nip 24 where the corrugated web joins a second web 28 that has been directed around pressure roller 16 and through the pressure nip 24. The presence of glue applied to the back of corrugated web 26 assures that web 26 is joined to flat web 28 as the same passes through pressure nip 24.

Disposed along side of corrugated roller 14 is a finger holder assembly indicated generally by the numeral 30. Finger holder assembly 30 supports a plurality of laterally spaced stripper fingers 38 adjacent roller 14. As will be appreciated from subsequent portions of this disclosure, the respective stripper fingers 38 serve to strip the corrugated web 26 from roller 12 and to guide the corrugated web 26 further around corrugated roller 14. The presence of stripper fingers 38 assures that corrugated web 26 is held closely adjacent corrugated roller 14 as the corrugated web 26 moves therearound.

Viewing finger holder assembly 30 in more detail, it is seen that the same includes an elongated support bar 40 that extends transversely adjacent corrugated roller 14 and generally extends parallel to the axis thereof. Supported along support bar 40 in lateral spaced apart relationship is a plurality of finger holders 32, with each finger holder 32 having a stripper finger 38 attached thereto. Generally finger holders 32 are closely spaced in conventional fashion.

Viewing the design of each finger holder 32, it is seen that the same includes opposite side portions **32*a* and an inclined attaching or resting surface 32*b* that is designed to rest adjacent said support bar 40 thereacross. In addition, an elongated slit 32*c* of approximately one-sixteenth of an inch thickness is provided therein for receiving a respective stripper finger 38. Finally, outside the slit 32*c*, there is provided two enlarged lost motions slots 32*d* that extend completely through finger holder 32 and slit 32*c*. Intermediately between lost motion slots 32*d*, there is provided another opening that serves as a jigging opening that is utilized to attach stripper finger 38 within finger holder 32**.

To rigidly support and stabilize the respective finger holders 32 about support bar 40, each finger holder is provided with an upstanding locking member that is adapted to engage support bar 40 in such a manner that the finger holder 32 is locked in position thereabout and cannot move from side to side. More particularly, in the design illustrated in FIGS. 2 and 3, the locking member comprises an upstanding locking stud **32*e* that extends above the attaching surface 32*b* but is narrower than the attaching surface 32*b* in order to accept support bar 40 therearound which is provided with a cutout 40*a* that is specifically designed to fit securely around locking stud 32*e*. Therefore, in the design illustrated in FIGS. 2 and 3, support bar 40 is placed adjacent attaching surface 32*b* such that locking stud 32*e* projects up through cutout 40*a*. Support bar 40 is firmly secured thereabout by the provision of a bolt 42 and washer 44 that is threaded into a threaded opening provided in the locking stud 32*e*. Thus, bolt 42 is tightened down to where the washer engages the upper surface of locking bar 40. It is thusly appreciated that the presence of locking stud 32*e* as it engages cutout 40*a* assures that finger holder 32 may not move from side to side or twist about the axis of bolt 42**.

Figure 4:
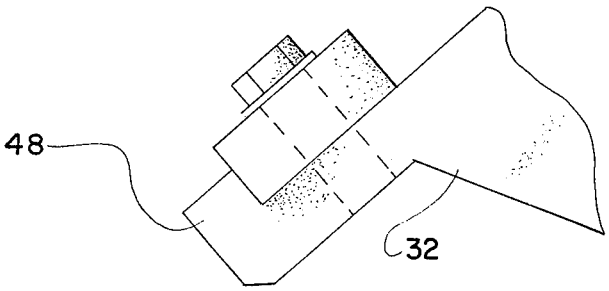
FIG. 4 is a fragmentary view illustrating an alternate design for the finger holder.

In FIG. 4, an alternate design is disclosed for the locking member. In this design, the rear edge of the inclined attaching surface **32*b* is raised to form a locking ledge 48 that engages the lower or rear edge 40*b* of the support bar 40. It is appreciated that the engagement of locking ledge 48 with the rear vertical edge 40***b* of support bar 40 assures that finger holder 32 may not twist or move from side to side about the axis of the associated attaching bolt 42. In this alternate design, it is appreciated that support bar 40 would include only a base type opening for receiving bolt 42 as opposed to a cutout such as shown in the design of FIG. 2.

Figure 2:
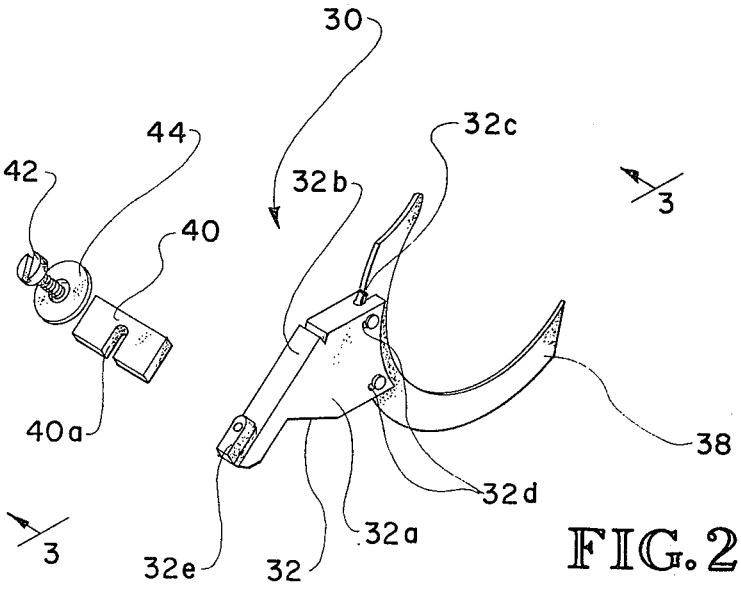
FIG. 2 is a perspective view illustrating one embodiment of the finger holder assembly of the present invention.
Figure 3:
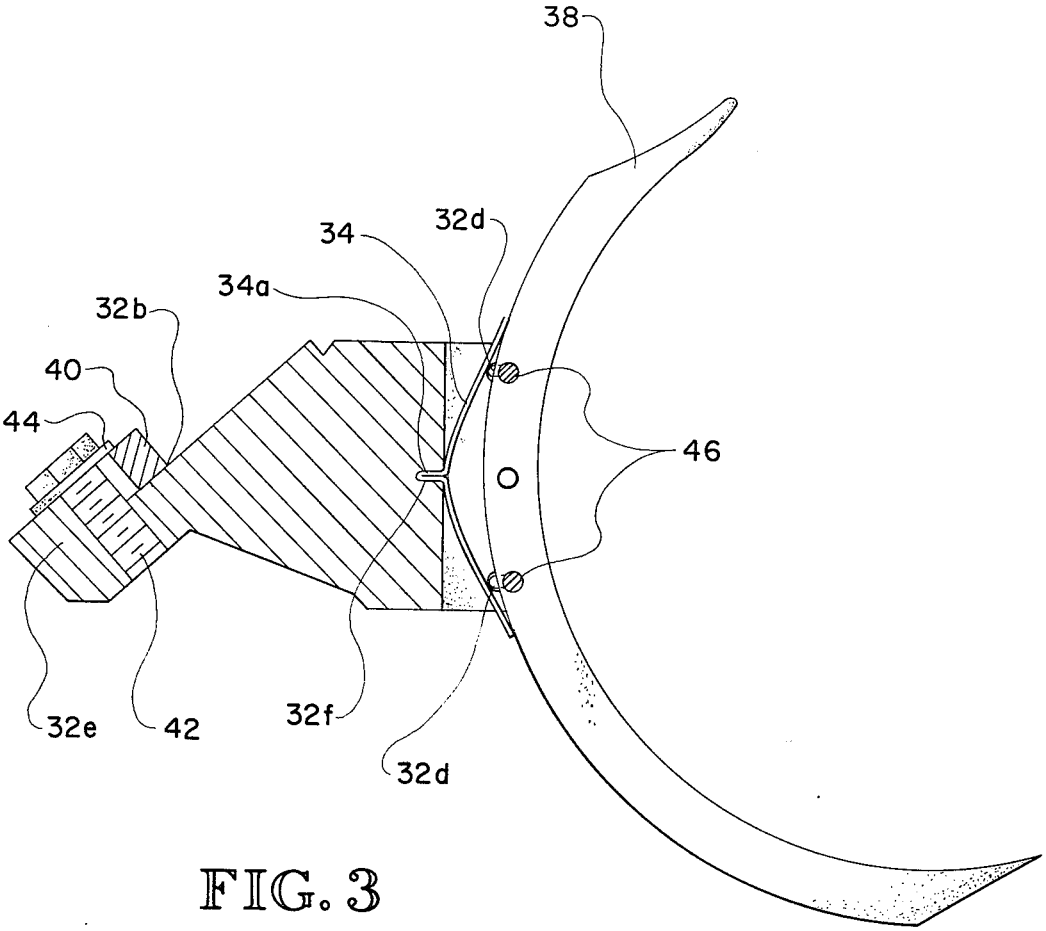
FIG. 3 is a side elevational sectional view, taken along the lines 3—3 of FIG. 1, of the finger holder assembly of the present invention particularly illustrating a flexible mounting means for mounting the stripper finger within the finger holder.

In the embodiment of FIG. 2, it is appreciated that the design of the support bar 40 and finger holder 32 is such that micro adjustments of the entire finger holder may be accomplished by simply adjusting the attaching surface 32*b* back and forth within cutout 40*a*.

To impart flexibility to the finger holder assembly 32, the same is provided with a leaf type spring 34 that is provided with a crimp portion 34*a* that fits within a spring slot 32*f* formed in the finger holder 32 adjacent slit opening 32*c*.

Stripper finger 38 is provided with two spaced apart openings. To secure stripper finger 38 within slit 32*c*, a pair of pins 46 are inserted through the lost motion slots 32*d* within the sides of finger holder 32 and on through the openings formed within the stripper fingers 38. The retaining pins 46 secure stripper fingers 38 within the slit opening 32*c*. Consequently, because of the lost motion or expanded openings 32*d* within finger holder 32, it is appreciated that stripper finger 38 may move back and forth within slit 32*c*. The presence of spring 34 biases stripper finger to a normal or biased position, while at the same time allowing the stripper finger to float back and forth therein to avoid binding when the same engages a portion of an associated roller or the corrugated web passing therebetween. This is particularly beneficial when the thickness of the corrugated web varies, as it does in practice.

Therefore, it is appreciated that the present invention locks the finger holder 32 in a rigid plane that will not allow the finger holder to skew back and forth and to become misaligned with the respective adjacent rollers of the corrugated cardboard manufacturing machine. In addition, spring 34 and the design of the finger holder assembly in that vicinity allows the stripper finger 38 to flex back and forth therein and to float when engaged by corrugated cardboard or other structure of the corrugated cardboard manufacturing machine. This avoids excessive wear to the stripper fingers 38 and prohibits against damage thereto.

Figure 5:
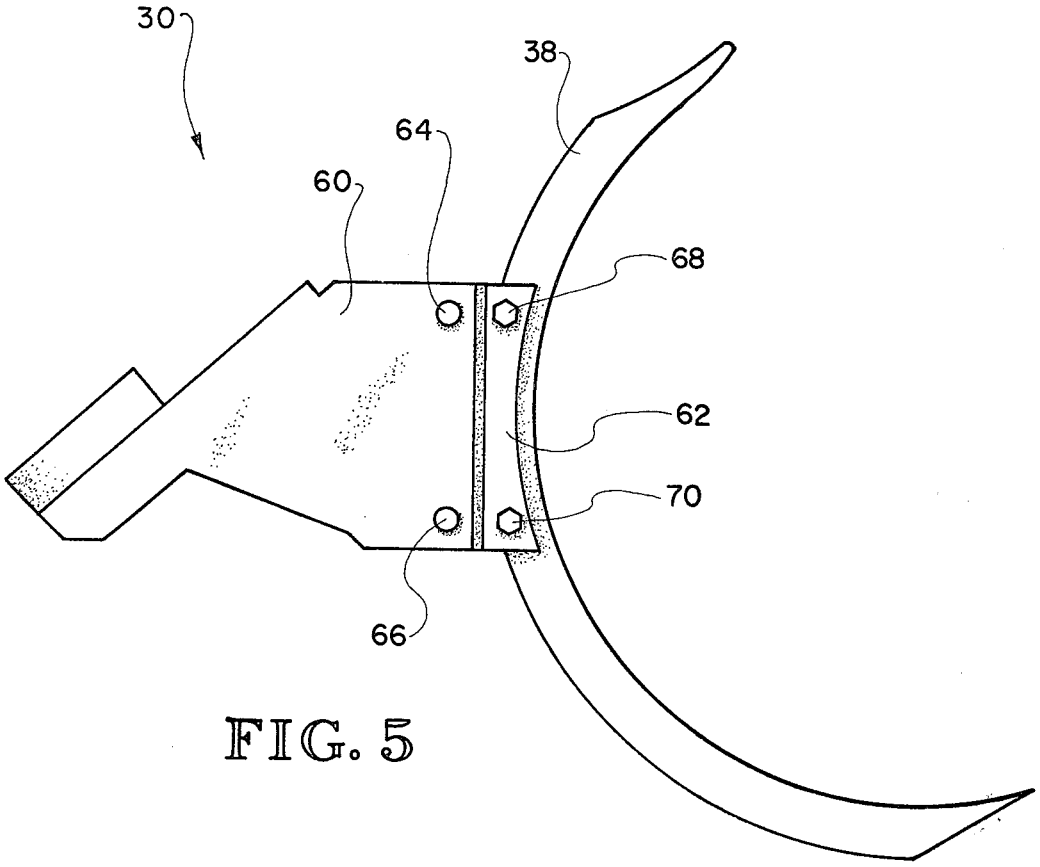
FIG. 5 is a side elevational view of an alternate design for the finger holder assembly of the present invention.
Figure 6:
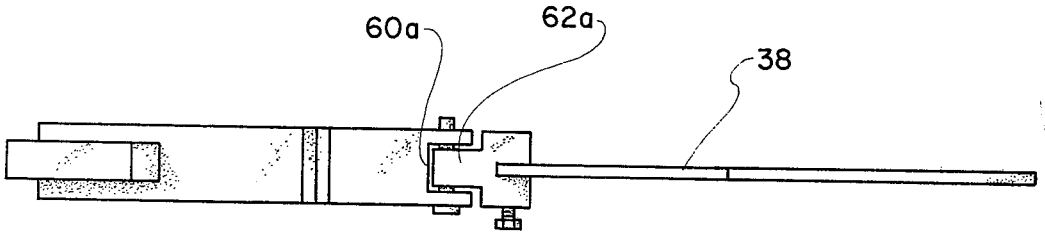
FIG. 6 is a top view of the alternate design shown in FIG. 5.

With respect to FIGS. 5 and 6, an alternate design is shown for the finger holder assembly 30. In this regard, the finger holder assembly includes a two part finger holder including a base section 60 and a finger holder section 62. Base section 60 includes a U-shaped groove or cavity 60*a* for receiving an insert or tongue 62*a* projecting from the finger holder section 62. Finger holder section 62 is connected to base section 60 by a pair of holding pins 64 and 66, with the holding pins 64 and 66 projecting through enlarged openings (not shown) and the tongue section 62*a* of the finger holder section 62, in order that the finger holder section 62 may move with respect to the base section 60 while being generally connected to the base section 60 by the respective pins.

More particularly, in the alternate embodiment, the spring 34 is positioned between the groove 60*a* of base section 60 and the rear edge of tongue 62*a* of the finger holder section 62. This means that the finger holder section 62 is biased to a normal holding position by the spring 34, but is yieldable due to the nature of the connection between the finger holder and base sections 60 and 62 and the presence of the spring 34.

Finger holder section 62 includes a slitted opening for receiving a stripper finger 38 in the same manner described hereinbefore. Provided with finger holder section 62 is a pair of securing screws 68 and 70 that serve to secure the stripper finger 38 within the finger holder section 62.

In all other respects, the alternate finger holder design shown in FIGS. 5 and 6 is essentially the same as that already discussed hereinbefore.

The terms "upper", "lower", "forward", "rearward", etc., have been used herein merely for the convenience of the foregoing specification and in the appended claims to describe the finger holder assembly and its parts as oriented in the drawings. It is to be understood, however, that these terms are in no way limiting to the invention since the finger holder assembly may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a web corrugating machine including first and second rotating corrugated rollers operatively meshed at a corrugating nip through which a flat web passes to become transformed into a corrugated web as the web moves from a first rotating corrugated roller, through the corrugating nip and onto said second corrugated roller, a pressure roll operatively disposed adjacent said second corrugated roller at a pressure nip through which the corrugated web and another flat web pass and are joined to form single face board, the improvement comprising: a stripper finger holder assembly for positioning and supporting respective stripper fingers between said nips in a generally rigid posture such that each stripper finger extends normal with respect to the axes of said corrugated rollers, said stripper finger holder assembly including: a support bar extending adjacent said corrugated rollers and generally parallel with respect to the axes thereof and including a plurality of laterally spaced vertical cut outs formed therein; a plurality of axially spaced finger holders mounted to said support bar; securing means for securing said finger holder to said support bar; stripper finger means secured to respective finger holders and extending therefrom such that the stripper fingers generally engage the corrugated web passing through the corrugated nip between said first and second corrugated rollers and urge the corrugated web from the first corrugated roller to a path that causes the corrugated web to follow the second corrugated roller and wherein said finger means generally supports the corrugated web about a substantial portion of the second corrugated roller between the corrugated nip and pressure nip; and wherein each finger holder includes an attaching edge that generally lies directly against said support bar when the respective finger holder is attached thereto, and wherein said finger holder further includes upstanding locking member means that projects above the attaching edge of said finger holder for engagement with said support bar at a level above the interface of said attaching edge and said support bar for preventing said finger holder from twisting side to side and to assure that the finger holder and associated stripper finger means is maintained in a rigid posture with the finger means extending in a plane normal to the axes of said first and second corrugated rollers, said upstanding locking member means including an upstanding locking stud that projects upwardly from the attaching edge of said finger holder and wherein said locking stud is adapted to fit and mate within said vertical cut out such that the engagement of said locking stud with said vertical cut out prevents said finger holder from twisting side to side.

2. The improved web corrugating machine of claim 1 wherein said upstanding locking member includes a locking ledge that projects above the attaching surface of said finger holder and which extends transversely thereacross so as to extend generally parallel with the axes of said corrugated rollers when said finger holder is appropriately mounted to said support bar; and wherein said support bar includes a locking edge that extends adjacent said locking ledge when said finger holder is mounted to said support bar so as to prevent said support bar from twisting side to side on said support bar.

3. The improved web corrugating machine of claim 2 wherein said locking stud is of a width less than the width of said attaching surface such that the support bar may set thereover with a portion thereof resting on said attaching surface of said finger holder while said locking stud projects upwardly through the vertical cut out formed therein.

4. The improved web corrugating machine of claim 2 wherein said locking ledge is formed along one extreme end portion of said attaching surface of said finger holder.

5. The improved web corrugating machine of claim 1 wherein said finger holder is provided with a vertical slit for receiving said finger means and wherein there is provided attaching means for attaching said finger means within said slit for flexible movement; and wherein there is provided biasing means operatively associated with said finger means and said finger holder for urging said finger means to a normal position after flexing.

6. The improved web corrugating machine of claim 5 wherein said biasing means includes a leaf type spring that is interposed within said slit formed within said finger holder and which engages said finger means.

7. The improved web corrugating machine of claim 6 wherein said flexible attaching means for attaching said finger means within said slit of said finger holder comprises at least two spaced apart lost motion slots formed through said finger holder, pin openings within said finger means, and further provided with pin means for extending through said lost motion slots within said finger holder and said pin openings within said finger means for allowing said finger means to flex back and forth therein.

8. The improved web corrugating machine of claim 7 wherein said biasing means includes a leaf spring crimped about an intermediate area, and wherein formed about a rear intermediate area of said slit is formed a receiving indention for receiving the crimped portion of said leaf spring, whereby the leaf spring can extend upwardly and rearwardly therefrom for engaging a rear edge of said finger means.

9. In a web corrugating machine including first and second rotating corrugated rollers operatively meshed at a corrugating nip through which a flat web passes to become transformed into a corrugated web as the web moves from a first rotating corrugated roller, through the corrugating nip and onto said second corrugated roller, a pressure roll operatively disposed adjacent said second corrugated roller at a pressure nip through which the corrugated web and another flat web pass and are joined to form single face board, the improvement comprising: a stripper finger holder assembly for positioning and supporting respective stripper fingers between said nips in a generally rigid posture such that each stripper finger extends normal with respect to the axes of said corrugated rollers, said stripper finger holder assembly including: a support bar extending adjacent said corrugated rollers and generally parallel with respect to the axes thereof; a plurality of axially spaced finger holders mounted to said support bar, each finger holder including a pair of separable connecting sections, and means for connecting said pair of sections together for imparting a degree of flexibility therebetween such that one section may yield and slightly move with respect to the other section; securing means for securing said finger holder to said support bar; stripper finger means secured to respective finger holders and extending therefrom such that the stripper fingers generally engage the corrugated web passing through the corrugated nip between said first and second corrugated rollers and urge the corrugated web from the first corrugated roller to a path that causes the corrugated web to follow the second corrugated roller and wherein said finger means generally supports the corrugated web about a substantial portion of the second corrugated roller between the corrugated nip and pressure nip; and wherein each finger holder includes an attaching edge that generally lies directly adjacent said support bar when the respective finger holder is attached thereto, and wherein said finger holder further includes upstanding locking member means that projects above the attaching edge of said finger holder for engagement with said support bar at a level above the interface of said attaching edge and said support bar for preventing said finger holder from twisting side to side and to assure that the finger holder and associated stripper finger means is maintained in a rigid posture with the finger means extending in a plane normal to the axes of said first and second corrugated rollers.

10. The improved web corrugating machine of claim 9 wherein said pair of connecting sections of said finger holder includes a base section and a finger holder section, and wherein there is provided spring biasing means operatively interposed between said base section and said finger holder section for allowing the finger holder section to flex back and forth with respect to said base section.

11. The improved web corrugating machine of claim 10 wherein each dual section finger holder includes holding pin means operatively interconnecting said base section with said finger holder section with a selected degree of lost motion in order that said finger holder section may move with respect to said base section.

* * * * *